US005473779A

United States Patent [19]

Kramer

[11] Patent Number: 5,473,779

[45] Date of Patent: Dec. 12, 1995

[54] SLEEPING BAG WITH EXPANSIBLE SEGMENT

[75] Inventor: Paul F. Kramer, Berkeley, Calif.

[73] Assignee: Mountain Hardwear, Inc., Berkeley, Calif.

[21] Appl. No.: 389,094

[22] Filed: Feb. 15, 1995

[51] Int. Cl.[6] ..... A47G 9/08

[52] U.S. Cl. ..... 2/69.5

[58] Field of Search ..... 2/69.5, 83, 114; 5/413, 494

[56] References Cited

U.S. PATENT DOCUMENTS

| | | | |
|---|---|---|---|
| 3,787,906 | 1/1974 | Hunt | 2/69.5 |
| 3,959,834 | 6/1976 | Hunt | 2/69.5 |
| 4,354,281 | 10/1982 | Satoh | 2/69.5 |
| 4,884,303 | 12/1989 | Scherer | 2/69.5 X |
| 4,888,828 | 12/1989 | Tatsuno . | |
| 4,989,282 | 2/1991 | Goldstein | 2/69.5 X |

FOREIGN PATENT DOCUMENTS

| | | | |
|---|---|---|---|
| 2229351 | 9/1990 | United Kingdom | 2/69.5 |

*Primary Examiner*—C. D. Crowder
*Assistant Examiner*—Shirra L. Jenkins
*Attorney, Agent, or Firm*—Thomas R. Lampe

[57] ABSTRACT

A sleeping bag includes a non-expansible, sleeve-like upper sleeping bag segment, a non-expansible, pocket-like lower sleeping bag segment and an outwardly expansible, sleeve-like intermediate sleeping bag segment. Together the sleeping bag segments form a sleeping bag inner chamber. Resilient bands of elastic material are located at the intermediate sleeping bag segment to maintain the intermediate sleeping bag segment in a condition which will not constrict or lessen the cross-sectional area of the bag inner chamber when the intermediate sleeping bag segment is in unexpanded condition.

9 Claims, 4 Drawing Sheets

SLEEPING BAG WITH EXPANSIBLE SEGMENT

TECHNICAL FIELD

This invention relates to a sleeping bag having a bag inner chamber for accommodating an individual. The sleeping bag includes an expansible, sleeve-like intermediate sleeping bag segment which contributes to the comfort of an individual occupying the bag.

BACKGROUND ART

Sleeping bags come in many shapes depending upon their intended use and cost. Mummy bags, semi-rectangular bags, and fully rectangular bags are the most common types and shapes of bags utilized for outdoor camping.

Mummy bags are generally fairly snug and are shaped to contour the body of occupants. Such an arrangement keeps the heat in by decreasing the air movement within the bag.

Semi-rectangular bags, in contrast, tend to contour the upper half of the occupant's body but have a much wider leg and foot section than that found in the mummy bag configuration. While semi-rectangular bags are generally more comfortable than mummy bags, because of the extra knee and leg room, bag warmth is decreased and weight and cost increased because of the extra fabric, insulation, and labor required for fabrication.

Fully rectangular bags tend to be the widest and most comfortable in that they do not restrict movement of the occupant's body to any substantial degree. However, fully rectangular bags are the least efficient (for their weight) in colder environments. Also, generally speaking, rectangular bags are too heavy, bulky, and inefficient to be considered for cold or high-altitude outdoor backpacking or mountaineering.

The warmth and weight of a sleeping bag is determined by the bag's design, shape, whether it has a foot or not, how much insulation is enclosed, the type and quality of insulation, and the type and quality of fabric used on the inside and outside of the bag.

U.S. Pat. No. 4,888,828, issued Dec. 26, 1989, relates to a sleeping bag device for bivouac use during mountain climbing, hiking and the like. The sleeping bag device disclosed in the aforesaid patent incorporates an arrangement alleged to provide higher warmth retention efficiency. In particular, the sleeping bag device of U.S. Pat. No. 4,888,828 incorporates elastic compression means, for example, rings of threads made of rubber, to constrict the sleeping bag and reduce the cross-sectional area of the inner chamber of the sleeping bag device, the purpose being to prevent the interior of the sleeping bag from communicating with the ambient air and thus avoid escape of warm air from the inner chamber as well as to prevent the introduction of cold ambient air into the sleeping bag device.

The principal location of such constriction of the bag is at the neck of the sleeper, the elastic compression member employed for such purpose keeping the bag in resilient contact with the neck of the sleeper. That is, the arrangement of U.S. Pat. No. 4,888,828 employs at least one elastic member, normally at the neck of the sleeper, which always serves to reduce the cross section of the inner chamber at least at the neck location of the occupant. The elastic member is always under tension when the cross section of the inner chamber does not have a reduced cross section or volume.

It will be appreciated that such an arrangement fails to add to the comfort of the occupant insofar as movement of the occupant's body is concerned. The mummy bag arrangements of the type shown, for example, in the aforesaid patent do not allow much freedom of body movement, restraining movement, for example, of the knees and legs, a restriction which is a particular irritant and source of discomfort to sleeping bag users. In addition, restricting bands of the type illustrated in the aforesaid patent which are always under tension when the inner chamber is at normal volume or cross section will cause some compression of the insulation and lessen the effectiveness of the bag to retain warmth and keep out the cold when occupied.

DISCLOSURE OF INVENTION

The sleeping bag of the present invention provides the advantages of a conventional mummy bag insofar as maintenance of heat and restriction of air movement within the bag is concerned. However, the sleeping bag of the present invention provides a degree of comfort not available in prior art mummy bags. More particularly, the sleeping bag of the present invention incorporates an expansible section which is of normal cross section or volume at rest but which expands outwardly when pushed from the inside by a person's knees or legs. The sleeping bag of this invention substantially increases the comfort of the bag while maintaining the bag's temperature rating while only minimally increasing the cost and weight of the bag.

Such an arrangement requires less insulation and material than would be the case for a rectangular or semi-rectangular bag allowing comparable leg and knee movement.

The sleeping bag of the present invention, while providing the comfort of a wide bag, has the appearance or look of a narrower, more efficient bag.

The sleeping bag of the present invention has a bag inner chamber for accommodating an individual.

The sleeping bag includes a non-expansible, sleeve-like upper segment defining an upper interior partially comprising the bag inner chamber and having first and second upper segment open ends communicating with the upper interior.

The first upper segment open end comprises a head opening allowing access to the sleeping bag inner chamber by an individual. The upper sleeping bag segment has an outer periphery of fixed dimension at the second upper segment open end.

The sleeping bag also includes a non-expansible, pocket-like lower sleeping bag segment defining a lower interior partially comprising the bag inner chamber for accommodating the feet of an individual occupying the bag inner chamber. The lower sleeping bag segment has a lower segment open end and a lower segment closed end. The lower sleeping bag segment has an outer periphery of fixed dimension at the lower segment open end.

The sleeping bag of the present invention also includes an expansible, sleeve-like intermediate sleeping bag segment defining an intermediate interior partially comprising the bag inner chamber and having two spaced intermediate segment ends communicating with the intermediate segment interior.

The intermediate sleeping bag segment is fixed to the upper sleeping bag segment and to the lower sleeping bag segment with one of the intermediate segment ends disposed at the second upper segment end and in registry therewith. The other of the intermediate segment ends is disposed at the lower segment open end.

The intermediate sleeping bag segment accommodates the knees of an individual occupying the bag inner chamber.

Resilient means is connected to the intermediate sleeping bag segment and extends about the intermediate sleeping bag segment normally maintaining the intermediate sleeping bag segment in unexpanded condition wherein said intermediate sleeping bag segment extends directly between the upper and lower sleeping bag segments and does not curve outwardly away therefrom.

The resilient means is essentially in a non-tension state when the intermediate sleeping bag segment is in unexpanded condition, and the resilient means expands under tension to permit outward expansion of the intermediate sleeping bag segment and an increase in size of the intermediate segment interior as well as movement of the intermediate sleeping bag segment outwardly and away from the upper and lower sleeping bag segments upon application of pressure to the intermediate sleeping bag segment by the knee of an occupant of the sleeping bag.

Other features, advantages, and objects of the present invention will become apparent with reference to the following description and accompanying drawings.

BEST MODE FOR CARRYING OUT THE INVENTION

Figure 2:
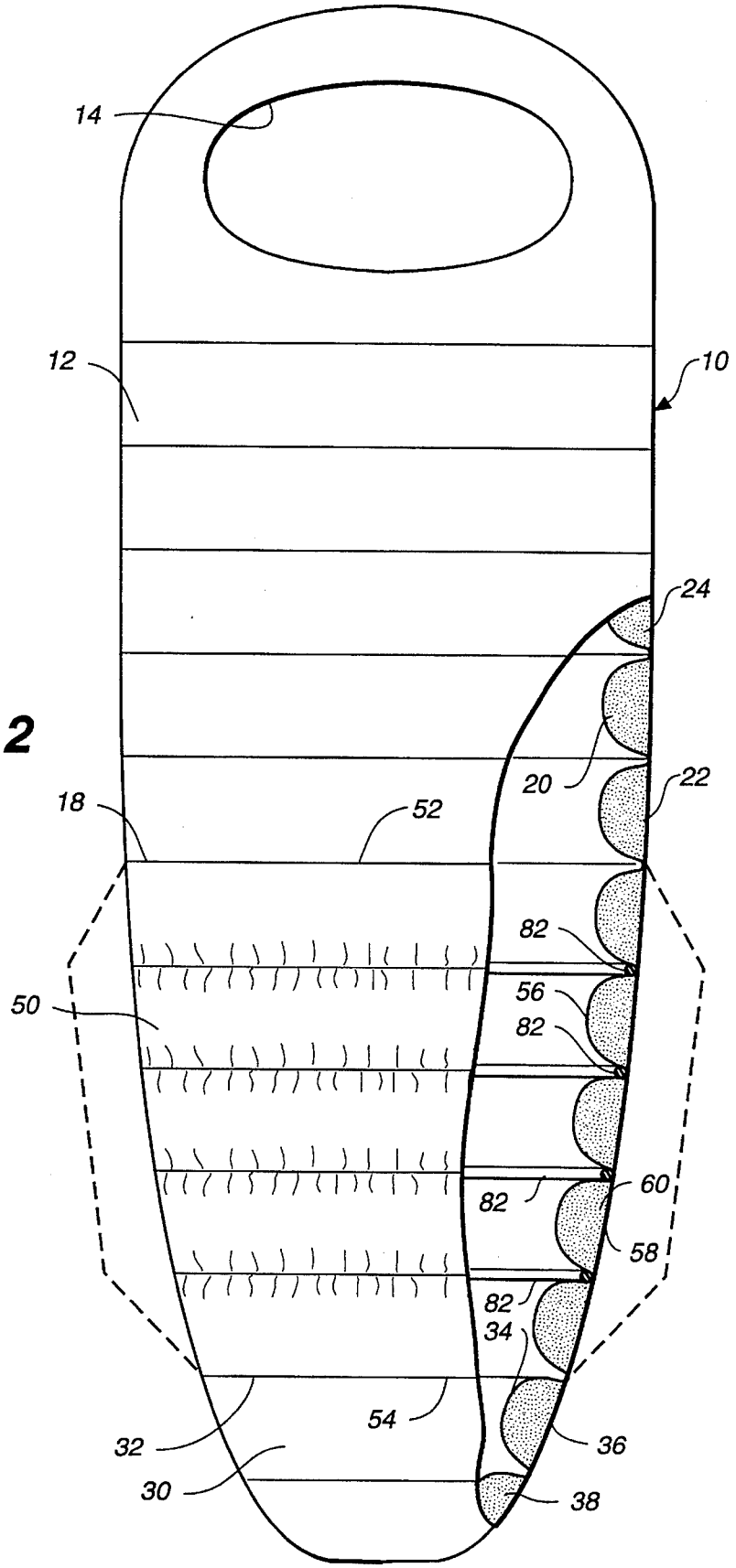
FIG. 2 is a plan view of a sleeping bag constructed in accordance with the teachings of the present invention with a portion thereof broken away and in cross section.
Figure 3:
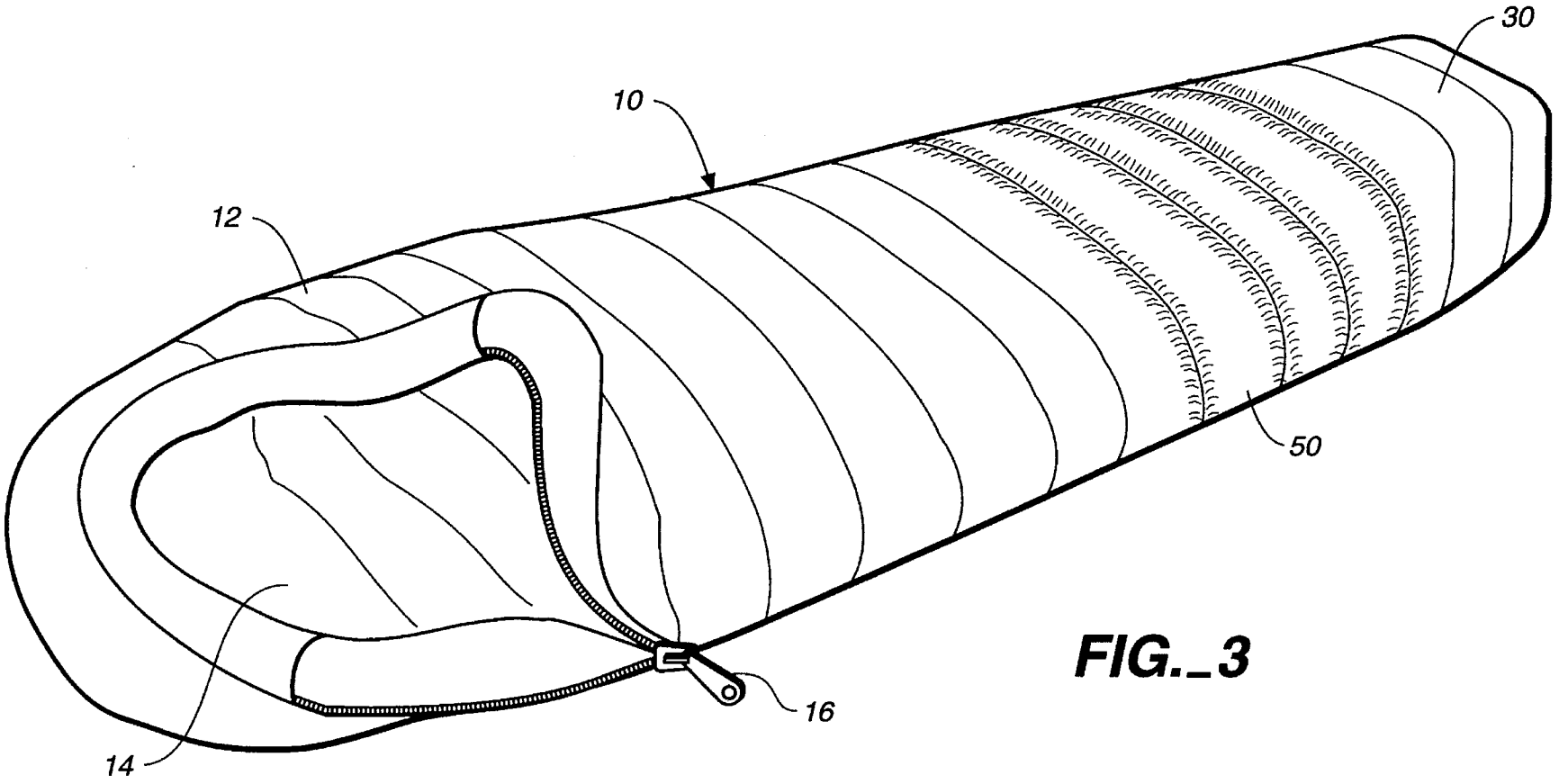
FIG. 3 is a perspective view of the sleeping bag of FIG. 2.
Figure 5:
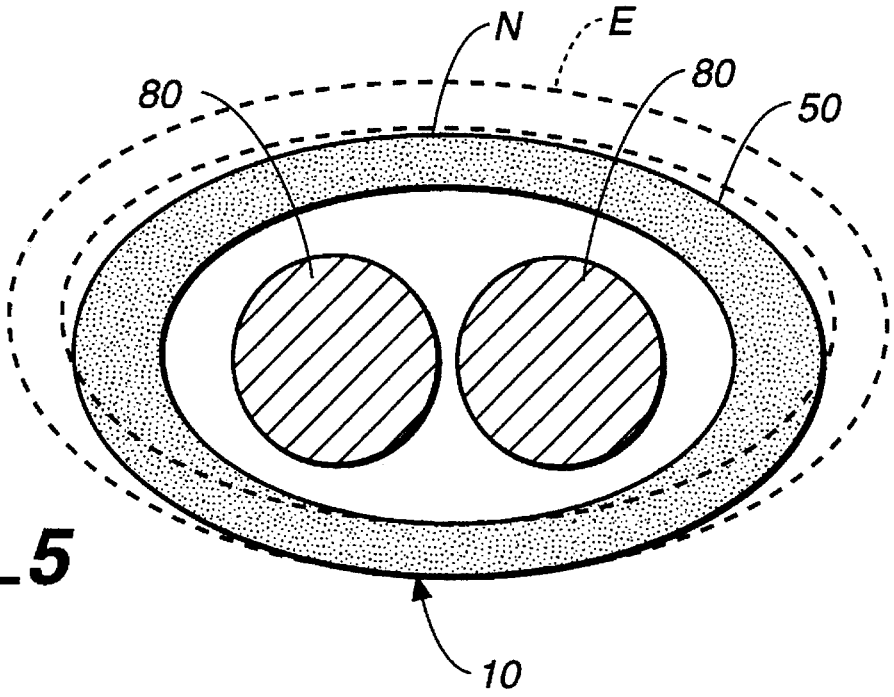
FIG. 5 is a schematic sectional view through the knee area of the sleeping bag of the present invention.

Referring now to FIGS. 2, 3 and 5, a sleeping bag constructed in accordance with the teachings of the present invention is illustrated and designated by reference numeral 10. Sleeping bag 10 is in the general shape of what is known as a mummy bag, the bag having an inner chamber for accommodating an individual (not shown) in the usual fashion.

Sleeping bag 10 includes a non-expansible, sleeve-like upper sleeping bag segment 12 defining an upper interior partially comprising the bag inner chamber and having first and second upper open ends communicating with the upper interior. The first upper segment open end comprises a head opening 14. A zipper 16 (FIG. 3) is deployed in the conventional fashion of mummy bags to expand the size of the head opening to permit ingress and egress with respect to the bag.

The second upper open end of the bag segment 12 is disposed at the location identified by reference numeral 18 in FIG. 2. A portion of the bag is illustrated as being broken away in FIG. 2 to disclose the second upper open end 18.

Upper sleeping bag segment 12 has an inner fabric layer 20, an outer fabric layer 22 and a layer of insulation 24 disposed therebetween. Outer fabric layer 22 may be of any suitable material such as nylon and is essentially non-stretchable. The inner fabric layer may be of like character. Upper sleeping bag segment 12 has an outer periphery of fixed dimension at the second upper segment open end 18.

The sleeping bag 10 also includes a non-expansible, pocket-like lower sleeping bag segment 30 defining a lower interior partially comprising the bag inner chamber for accommodating the feet of an individual occupying the bag inner chamber. The lower sleeping bag segment 30 has a lower segment open end 32 having an inner fabric layer 34, outer fabric layer 36, and insulation 38 disposed between layers 34, 36.

The outer fabric layer 36 of the lower sleeping bag segment is also formed of suitable essentially non-stretchable fabric, and the lower sleeping bag segment has an outer periphery of fixed-dimension at the lower segment open end 32.

Located between sleeping bag segments 12 and 30 is an expansible, sleeve-like intermediate sleeping bag segment 50 defining an intermediate interior partially comprising the bag inner chamber and having two spaced, open intermediate segment ends 52, 54 communicating with the intermediate segment interior.

Intermediate sleeping bag segment 50 is affixed to both the upper sleeping bag segment 12 and the lower sleeping bag segment 30 by stitching or other conventional expedient.

Intermediate sleeping bag segment end 52 is disposed at the second upper segment end 18 and in registry therewith. Intermediate sleeping bag segment end 54 is disposed at the lower segment open end 32 and in registry therewith.

The intermediate sleeping bag segment inner and outer fabric layers 56, 58 are formed of excess material to allow for the outward expansion of the intermediate sleeping bag segment from the solid line condition illustrated in FIG. 2 to the indicated dash line condition or location.

Intermediate sleeping bag segment 50 accommodates the knees of an individual occupying the bag inner chamber and the inner and outer fabric layers 56, 58 of the intermediate sleeping bag segment, will move outwardly upon application of knee pressure by the bag's occupant to increase the size of the bag inner chamber at the intermediate sleeping bag segment. As can be seen in FIG. 2, the intermediate sleeping bag segment is outwardly expandable beyond the outer periphery of the upper sleeping bag segment at the second upper segment open end 18 and the outer periphery of the lower sleeping bag segment at the lower segment open end 32. This provides a degree of comfort to the occupant not found in convention mummy bag constructions.

Resilient means is provided at the intermediate sleeping bag segment normally maintaining the intermediate sleeping bag segment in its unexpanded condition, i.e., the condition illustrated in solid lines in FIG. 2, wherein the intermediate sleeping bag segment does not extend beyond the outer periphery of the upper sleeping bag segment at the second upper segment open end and the outer periphery of the lower sleeping bag segment at the lower segment open end.

It is important to note that the intermediate sleeping bag segment when in its unexpanded condition does not reduce the normal cross-sectional area of the inner chamber of the sleeping bag, the resilient means employed in the construction of the bag being in a state of non-tension when the intermediate sleeping bag segment is in unexpanded condition.

In the arrangement illustrated, sleeping bag 10 has the overall configuration of a mummy bag when the intermediate segment is in the unexpanded or normal condition and the resilient means cooperating with the intermediate sleeping bag segment is in a state of non-tension. In such condition, the intermediate sleeping bag segment extends directly between the upper and lower sleeping bag segments and does not curve outwardly away therefrom. The sleeping bag inner chamber is not constricted or reduced from its normal volume or cross section and essentially has the shape and cross section of an inner chamber of a conventional mummy bag. The insulation 60 of the intermediate sleeping bag segment is essentially uncompressed by the resilient means when the intermediate sleeping bag segment is in unexpanded condition.

Figure 1:
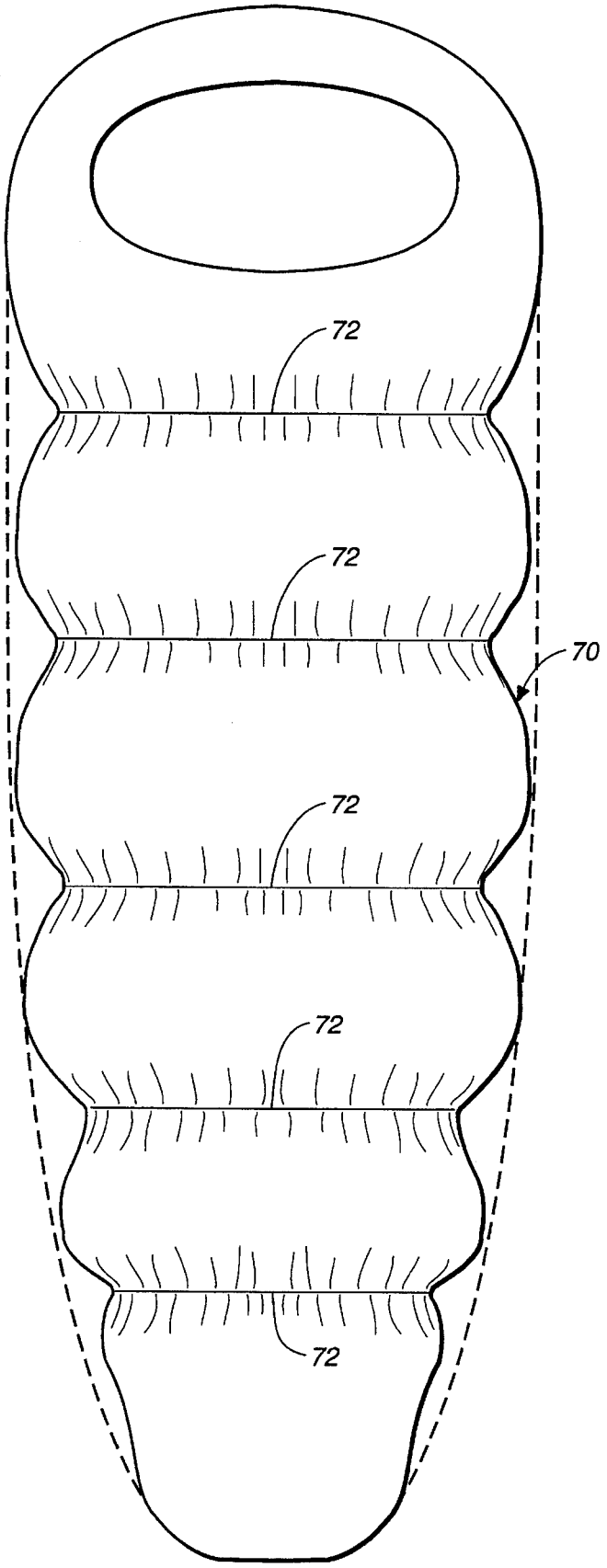
FIG. 1 (PRIOR ART)
FIG. 1 is a plan view of a prior art sleeping bag.
Figure 4:
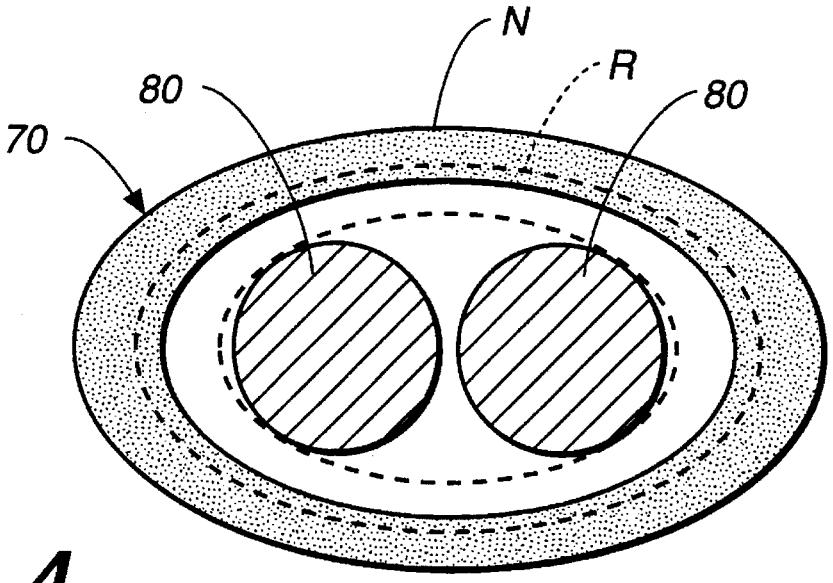
FIG. 4 (PRIOR ART)
FIG. 4 is a schematic sectional view through the knee area of a prior art sleeping bag such as that shown in FIG. 1.

The construction and function of sleeping bag 10 is quite different from that of a sleeping bag constructed in accordance with the teachings of U.S. Pat. No. 4,888,828, for example. FIGS. 1 and 4 illustrate a bag 70 constructed in accordance with the teachings of that patent. FIG. 1 shows the complete bag and FIG. 4 shows a somewhat stylized cross section taken through the knee section of the bag. Bag 70 incorporates bands 72 of constrictive material spaced therealong. These bands are tensioned to reduce the normal cross section of the bag inner chamber. Sleeping bag 10, by way of contrast, has the normal inner chamber cross section and space of a conventional mummy bag when the intermediate sleeping bag segment is in unexpanded condition. FIGS. 4 and 5 provide illustrations, respectively, of the segments of the prior art bag 70 and the subject sleeping bag 10 in the vicinity of the occupant's legs 80. In the prior art bag 70, the elastic bands or threads at such location bring the bag into the dash line condition illustrated in FIG. 4 and designated by the letter R inwardly from the normal condition or position of the bag which is indicated by the solid lines and designated by reference letter N.

In FIG. 5, the intermediate sleeping bag segment 50 is in the solid line condition designated by letter N when the resilient means is in a state of non-tension. Normal room and comfort of a conventional bag is maintained. Applicant's invention allows outward force exerted by legs 80 to move the intermediate sleeping bag segment outwardly to the dash line configuration illustrated in FIG. 5 and designated by the letter E to afford more room if necessary.

The upper sleeping bag segment 12 and the lower sleeping bag segment 30 of sleeping bag 10 are devoid of elastic material so that these two segments are configured and operate in the manner of corresponding segments on a conventional mummy bag.

A suitable form of resilient means for use when practicing the present invention has been found to be spaced bands of elastic material secured and located at spaced locations along the intermediate sleeping bag segment. These bands (somewhat exaggerated in size) are identified by reference numerals 82. The elastic bands completely encircle the intermediate sleeping bag segment.

I claim:

1. A sleeping bag having a bag inner chamber for accommodating an individual, said sleeping bag comprising, in combination:

a non-expandable, sleeve-like upper sleeping bag segment defining an upper interior partially comprising said bag inner chamber and having first and second upper segment open ends communicating with said upper interior, said first upper segment upper end comprising a head opening allowing access to the sleeping bag inner chamber by an individual, and said upper sleeping bag segment having an outer periphery of fixed dimension at said second upper segment open end;

a non-expansible, pocket-like lower sleeping bag segment defining a lower interior partially comprising said bag inner chamber for accommodating the feet of an individual occupying the bag inner chamber and having a lower segment open end and a lower segment closed end, and said lower sleeping bag segment having an outer periphery of fixed dimension at the lower segment open end;

an outwardly expansible, sleeve-like intermediate sleeping bag segment defining an intermediate interior partially comprising said bag inner chamber and having two spaced intermediate segment ends communicating with said intermediate segment interior, and said intermediate sleeping bag segment affixed to said upper sleeping bag segment and to said lower sleeping bag segment with one of said intermediate segment ends disposed at the second upper segment open end and in registry therewith and the other of the intermediate segment ends disposed at the lower segment open end and in registry therewith, said intermediate sleeping bag segment accommodating the knees of an individual occupying the bag inner chamber; and resilient means connected to said intermediate sleeping bag segment and extending at least partially about said intermediate sleeping bag segment normally maintaining said intermediate sleeping bag segment in an unexpanded condition wherein said intermediate sleeping bag segment extends substantially directly between said upper and lower sleeping bag segments and does not curve outwardly away therefrom, said resilient means being essentially in a non-tension state when said intermediate sleeping bag segment is in said unexpanded condition, and said resilient means expanding under tension to permit outward expansion of said intermediate sleeping bag segment and an increase in size of the intermediate interior and said bag inner chamber as well as movement of the intermediate sleeping bag segment outwardly away from said upper and lower sleeping bag segments upon application of pressure to the intermediate sleeping bag segment by a knee of an occupant of the sleeping bag.

2. The sleeping bag according to claim 1 wherein said upper sleeping bag segment, said lower sleeping bag segment, and said intermediate sleeping bag segment each include an outer fabric layer, an inner fabric layer, and insulation disposed between said inner and outer fabric layers, the insulation of said intermediate sleeping bag segment being essentially uncompressed by said resilient means when said intermediate sleeping bag segment is in unexpanded condition.

3. The sleeping bag according to claim 2 wherein said resilient means comprises spaced bands of resilient material encircling said intermediate sleeping bag segment at spaced locations thereon.

4. The sleeping bag according to claim 3 wherein said spaced bands are secured to said intermediate bag segment.

5. The sleeping bag according to claim 3 wherein said bands of resilient material are located at and connected to both the inner fabric layer and outer fabric layer of said intermediate sleeping bag segment.

6. The sleeping bag according to claim 2 wherein the outer fabric layer of said intermediate sleeping bag segment has a girth exceeding the maximum girths of both said upper sleeping bag segment and said lower sleeping bag segment when said intermediate bag segment is in expanded condition.

7. The sleeping bag according to claim 1 wherein said upper sleeping bag segment and said lower sleeping bag segment are devoid of resilient material which would exert constrictive forces on said upper sleeping bag segment or on said lower sleeping bag segment.

8. The sleeping bag according to claim 1 wherein said upper sleeping bag segment is the upper segment of a mummy bag and wherein said lower sleeping bag segment is the lower segment of a mummy bag.

9. A sleeping bag having a bag inner chamber for accommodating an individual, said sleeping bag comprising, in combination:

a non-expansible, sleeve-like upper sleeping bag segment defining an upper interior partially comprising said bag inner chamber and having first and second upper segment open ends communicating with said upper interior, said first upper segment open end comprising a head opening allowing access to the sleeping bag inner chamber by an individual, said upper sleeping bag segment having an inner fabric layer, an outer fabric layer, and insulation disposed between said inner and outer fabric layers, said outer fabric layer formed of essentially non-stretchable fabric, and said upper sleeping bag segment having an outer periphery of fixed dimension at said second upper segment open end;

a non-expansible, pocket-like lower sleeping bag segment defining a lower interior partially comprising said bag inner chamber for accommodating the feet of an individual occupying the bag inner chamber and having a lower segment open end and a lower segment closed end, said lower sleeping bag segment having an inner fabric layer, an outer fabric layer, and insulation disposed between said inner and outer fabric layers, the outer fabric layer of the lower sleeping bag segment formed of essentially non-stretchable fabric, and said lower sleeping bag segment having an outer periphery of fixed dimension at the lower segment open end;

an expansible, sleeve-like intermediate sleeping bag segment defining an intermediate interior partially comprising said bag inner chamber and having two spaced, open intermediate segment ends communicating with said intermediate segment interior, and said intermediate sleeping bag segment affixed to said upper sleeping bag segment and to said lower sleeping bag segment with one of said intermediate segment ends disposed at the second upper segment open end and the other of the intermediate segment ends disposed at the lower segment open end, said intermediate sleeping bag segment accommodating the knees of an individual occupying the bag inner chamber and outwardly expandable beyond the outer periphery of said upper sleeping bag segment at said second upper segment open end and the outer periphery of said lower sleeping bag segment at said lower segment open end upon application of knee pressure to increase the size of the bag inner chamber at the intermediate sleeping bag segment; and resilient means at said intermediate sleeping bag segment normally maintaining said intermediate sleeping bag segment in an unexpanded condition wherein said intermediate sleeping bag segment does not substantially extend beyond the outer periphery of said upper sleeping bag segment at said second upper segment open end and the outer periphery of said lower sleeping bag segment at said lower segment open end, said intermediate sleeping bag segment when in said unexpanded condition not reducing the normal cross-sectional area of the bag inner chamber, and said resilient means being essentially in a state of non-tension when said intermediate sleeping bag segment is in unexpanded condition.

* * * * *